United States Patent [19]

Washkuhn

[11] Patent Number: 4,533,351

[45] Date of Patent: Aug. 6, 1985

[54] FOAM RUBBER INSOLES CONTAINING OTTACIDE-P

[75] Inventor: Richard J. Washkuhn, Penfield, N.Y.

[73] Assignee: Pennwalt Corporation, Philadelphia, Pa.

[21] Appl. No.: 371,969

[22] Filed: Apr. 26, 1982

[51] Int. Cl.[3] ..... A43B 13/38

[52] U.S. Cl. ..... 604/293; 128/383; 128/581; 604/19; 604/290; 604/304; 36/43

[58] Field of Search ..... 604/890, 892, 896, 897, 604/19, 289, 290, 293, 304; 128/581, 595, 383, 155, 156, 165; 424/16; 36/43, 44

[56] References Cited

U.S. PATENT DOCUMENTS

Re. 29,501 12/1977 Lapidus ..... 36/44

2,061,911 11/1936 Leindorf ..... 36/43

OTHER PUBLICATIONS

Ritzinger, "Fungus Resistance of Neoprene," Rubber & Plastics Age, 40, 1067–1069 (1959).

Product Brochure of Ottawa Chemical Division of Ferro Corporation for Ottacide-P, Technical Pamphlet No. 19, Jan. 1959 (2 pages).

Chemical & Engineering News, Jan. 26, 1959, p. 49.

*Primary Examiner*—C. Fred Rosenbaum

*Assistant Examiner*—Harrie R. Samaras

[57] ABSTRACT

The impregnation of a foam rubber, or similar polymeric material, insole with an effective antibacterial and antifungal agent along with a deodorant provides a simple, clean source of active ingredients for curative and prophylactic treatment of infections of the feet and reduces odors during the course of the treatment. The agent of choice in such a product must be stable to the conditions of use and be sufficiently non-volatile to be retained in the insole over a period of days or weeks.

11 Claims, No Drawings

FOAM RUBBER INSOLES CONTAINING OTTACIDE-P

BACKGROUND OF THE INVENTION

The present invention is related to foam rubber insoles which contain an antimicrobial agent to inhibit the growth of bacteria and fungi so as to aid in the prevention and treatment of microbial infections such as athlete's foot. The insoles typically further contain a deodorizing agent.

When feet are enclosed in shoes, sneakers, etc., they have a tendency to perspire. This warm, moist condition is ideal in promoting the prolific growth of bacteria and fungi. The organisms can produce an unpleasant, undesirable odor during proliferation and also can cause infections of the foot leading to the common condition known as athlete's foot. The regular application of an antimicrobial and antifungal agent to the infected area will cure or alleviate the infection, but compliance with a regimen of topical applications is difficult and, furthermore, the use of powders, creams and/or lotions causes soiling of footwear such as socks and shoes. A clean, dry, and long-acting source of the antimicrobial agent in contact with the source of infection is very desirable.

Initial attempts to use an antimicrobial agent such as parachlorometaxylenol (PCMX) were unsuccessful due to the volatility of the compound, which resulted in its loss during manufacture of the insole as a result of the heat treatment required for curing of the preparation. A solution to this problem is achieved by the present invention by using Ottacide-P (trademark of Ottawa Chemical Division of Ferro Corporation), a stable, non-volatile borate ester of PCMX having the formula:

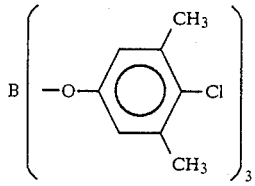

Ottacide-P is only partially lost during the manufacture of the insole and as such it retains its antimicrobial activity.

It has been reported that Ottacide-P is useful fungicide when incorporated in plastics. Ritzinger, *Rubber & Plastics Age* 40, 1067 (1959), indicates that Ottacide-P is a useful fungicide when compounded with neoprene. The product brochure of Ottawa Chemical Division of Ferro Corporation for Ottacide-P and *Chemical Engineering News,* Jan. 26, 1959, p. 49, indicate that Ottacide-P inhibits fungus growth on polyvinylchloride and its copolymers when incorporated therein. None of these references describes the concept of the present invention wherein the impregnated foam rubber acts as a source of antifungal agent to protect the user from infection and to aid in treatment of infection if contacted before use of the impregnated insoles.

SUMMARY OF THE INVENTION

The present invention provides for foam rubber insoles impregnated with Ottacide-P. Examples of polymeric materials useful for preparing the foam rubber include rubber latex, polyurethane/latex combinations, polypropylene/latex combinations, and butyl foam/-latex combinations. It is preferred that the final content of Ottacide-P in the impregnated insole be from about 0.5% to about 5%. In a preferred embodiment, the impregnated insole also contains about 1% to about 10% of a deodorizer, e.g., sodium bicarbonate. The impregnated insole is prepared by mixing a slurry of the uncured latex with the additives, then casting the slurry into suitable support fabric and drying and curing the foam pad. The impregnated insoles are useful in shoes to inhibit the growth of bacteria and fungi and to act as a treatment of microbial infections such as athlete's foot.

DETAILED DESCRIPTION OF THE INVENTION

Foam rubber insoles can be formed from numerous polymeric materials. The following polymeric materials are suitable for preparing foam rubber insoles: rubber latex, polyurethane/latex combinations, polypropylene/latex combinations, and butyl foam/latex combinations. According to the present invention, the impregnated foam rubber insolve, i.e., the final cured product, contains from about 85% to about 99.5% of the polymeric materials.

The foam rubber insoles are prepared so that they contain the antibacterial, antifungal agent Ottacide-P. The finished, cured foam rubber insoles contain from about 0.5% to about 5.0% Ottacide-P, although higher or lower amounts may be used. It was discovered that about 70% of the Ottacide-P which was added to the latex mixture was volatilized during the curing process. As a result, it is necessary to add about 3⅓ times the desired final concentration of Ottacide-P to the latex formulation in order to obtain the desired concentration in the cured insole.

A further aspect of the invention is to prepare the foam rubber insoles so that the cured product contains a deodorizing agent, e.g., sodium bicarbonate, in addition to Ottacide-P. This optional ingredient is utilized to control odor. If the cured foam rubber insole contains a deodorizing agent, it is present in a concentration from about 1% to about 10%. Consequently, the impregnated, cured foam rubber insole has the following composition:

| | Generally | Preferred |
|---|---|---|
| Polymeric material (foam rubber) | 85–99.5% | 85–98.5% |
| Ottacide-P | 0.5–5% | 0.5–5% |
| Deodorizing Agent | 0–10% | 1.0–10% |

The foam rubber insoles are prepared by mixing a slurry of the uncured latex with the Ottacide-P and deodorizing agent, if desired, in appropriate concentrations to provide the concentrations described above in the cured product. The slurry is then cast onto a suitable support fabric such as bleached white drill material. The support fabric may be any of those conventionally used in preparing foam rubber insoles. The coated fabric is then dried and the latex cured at temperatures well known to workers in the art to yield the finished foam rubber insole pad. The pad can then be cut and shaped to the desired dimensions as is again well known in the art.

The impregnated foam rubber insoles are inserted in shoes. The deodorizing agent helps reduce or eliminate foot odor. The Ottacide-P functions to inhibit the growth of bacteria and fungi. The foam rubber insoles of the present invention have been found to act as a treatment for microbial infections, such as athlete's foot, upon use of the insole.

The invention will be further described by the following examples:

EXAMPLE 1

Ottacide-P and sodium bicarbonate were added to a latex mixture comprising rubber latex. The foam rubber insoles were prepared from this mixture according to established methods in the art of manufacturing foam rubber insoles. Three foam rubber insoles were prepared which had the following composition before curing and after curing:

| | uncured mixture | insole |
|---|---|---|
| (A) Ottacide-P | 1.50% | 0.43% |
| $NaHCO_3$ | 1.10% | 1.10% |
| latex | 97.4% | 98.47% |
| (B) Ottacide-P | 3.00% | 1.22% |
| $NaHCO_3$ | 1.10% | 1.10% |
| latex | 95.9% | 97.68% |
| (C) Ottacide-P | 3.00% | 0.80% |
| $NaHCO_3$ | 1.10% | 1.10% |
| latex | 95.9% | 98.10% |

EXAMPLE 2

Foam rubber insoles were prepared as in Example 1 and were packaged in foil. The stability of the packaged foam rubber insoles to moisture and heat was examined over a period of six months. No significant loss of the Ottacide-P and sodium bicarbonate was noted over this time period. The results of this test are shown in Table 1.

TABLE 1

Stability Data for Ottacide-P Impregnated Foam Pads in Three Different Foil Laminate Packages at 37° C. and at 70% RH at 23° C.

| # | 1 | | 2 | | 3 | |
|---|---|---|---|---|---|---|
| Time (mos.) | % Ottacide-P | % $NAHCO_3$ | % Ottacide-P | % $NaHCO_3$ | % Ottacide-P | % $NaHCO_3$ |
| | | | at 37° C. | | | |
| 0 | 0.82 | 1.14 | 0.82 | 1.14 | 0.82 | 1.14 |
| 1 | 0.89 | 1.39 | 0.97 | 1.67 | 0.77 | 1.44 |
| 3 | 0.49 | 1.27 | 0.87 | 1.47 | 0.93 | 1.47 |
| 6 | 0.88 | 1.42 | 0.78 | 1.41 | 0.71 | 1.28 |
| | | | at 70% Relative Humidity at 23° C. | | | |
| 0 | 0.82 | 1.14 | 0.82 | 1.14 | 0.82 | 1.14 |
| 1 | 0.71 | 1.38 | 0.83 | 1.55 | 0.71 | 1.47 |
| 3 | 0.54 | 1.29 | 0.87 | 1.45 | 0.96 | 1.53 |
| 6 | 0.79 | 1.36 | 0.64 | 1.41 | 0.77 | 1.37 |

#1 as packaged in IL-141 laminate (Polyethylene/foil/Polyethylene).
#2 was packaged in L-161 laminate (Polyethylene/foil/Polyethylene).
#3 was packaged in M-079 laminate (Polyethylene/foil/Polyethylene).

EXAMPLE 3

The foam rubber insoles A and B were tested for antifungal activity against a number of organisms according to the following procedures:

SEEDED AGAR PLATE METHOD FOR TESTING FUNGISTATIC ACTIVITY

A. Stock cultures of test fungi are maintained on Dextrose Neopeptone Agar at room temperature under sterile mineral oil. All strains are pathogenic isolates recovered from patient's lesions.

B. Preparation of Conidial Suspensions. Test fungi were grown on Brain-Heart Infusion agar plates for approximately two weeks to allow for luxurious conidial production. The aerial mycelia were harvested in physiologic saline with 0.05% Tween-80. The resulting suspensions were filtered through gauze and sterile absorbent cotton to remove hyphal elements but to allow the conidia to filter through. The density of the conidial suspensions was determined by counting on a hemacytometer. Suspensions were standardized to a final use concentration of approximately 5 million conidia/ml.

C. The Agar Plate Technique. Tubes containing 30 ml of Mycosel agar were melted and cooled at 45° C. and then inoculated with 0.2 ml of the fungal conidial suspensions. The inoculated agar was then poured aseptically into sterile disposable 9 mm petri dishes and allowed to solidify. Discs of foam rubber samples, 18 mm in diameter, were implanted in the center of the plate. Plates were incubated at 30° C. for seven to 10 days, at which time there were sharply defined zones of confluent growth surrounding the clear zones of growth inhibition around the disc. The diameters of the clear zones were measured and recorded.

The results are shown in Table 2, in which it can be seen that the foam rubber insoles were effective in inhibiting the growth of the various fungi.

TABLE 2

Inhibition of Fungal Growth by Foam Rubber Insoles

| Test Organism | Diameter of Zones of Inhibition (mm) 1 A | B |
|---|---|---|
| *Trichophyton mentagrophytex* #1 | 43 | 60 |
| *Trichophyton mentagrophytes* #2 | 41 | 54 |
| *Trichophyton rubrum* #1 | 51 | 63 |
| *Trichophyton rubrum* #2 | 45 | 58 |
| *Epidermophyton flocossum* #1 | 50 | 61 |
| *Epidermophyton flocossum* #2 | 52 | 64 |
| *Candida albicans* #1 | 24 | 38 |
| *Candida albicans* #2 | 25 | 36 |

1 Diameter of rubber foam disc = 18 mm.

While the invention has been described in connection with specific embodiments thereof, it will be understood that it is capable of further modifications. This application is intended to cover any variations, uses or adaptations of the invention following, in general, the principles of the invention and including such departures from the present disclosure as come within known and customary practice within the art to which the invention pertains.

What is claimed is:

1. A foam rubber insole comprising from about 0.5% to about 5% by weight of tris(para-chloro-metax-ylenol)borate, from about 0% to about 10% by weight of a deodorizing agent, and from about 85% to about 99.5% by weight of a cured latex.

2. The foam rubber insole of claim 1 which comprises from about 1% to about 10% by weight of a deodorizing agent.

3. The foam rubber insole of claim 1 or 2 wherein said deodorizing agent is sodium bicarbonate.

4. The foam rubber insole of claim 1 or 2 wherein said cured latex is selected from the group consisting of a cured rubber latex, a cured polyurethane-latex combination, a cured polypropylene-latex combination, and a butyl foam-latex combination.

5. The foam rubber insole of claim 3 wherein said cured latex is selected from the group consisting of a cured rubber latex, a cured polyurethane-latex combination, a cured polypropylene-latex combination, and a cured butyl foam-latex combination.

6. A method for the treatment of microbial infections, including athletes foot, on a human foot by inserting a foam rubber insole comprising from about 0.5% to about 5% by weight of tris(para-chloro-meta-xylenol)-borate, from about 0% to about 10% by weight of a deodorizing agent, and from about 85% to about 99.5% by weight of a cured latex into a shoe and subsequently contacting said foot with said insole.

7. The method of claim 6 wherein said foam rubber insole comprises from about 1% to about 10% by weight of a deodorizing agent.

8. The method of claim 6 or 7 wherein said deodorizing agent is sodium bicarbonate.

9. A method of inhibiting the growth of bacteria or fungi in a shoe by inserting a foam rubber insole comprising from about 0.5% to about 5% by weight of tris(para-chloro-meta-xylenol)borate, from about 0% to about 10% by weight of deodorizing agent, and from about 85% to about 99.5% by weight of a cured latex into said shoe.

10. The method of claim 9 wherein said foam rubber insole comprises from about 1% to about 10% by weight of a deodorizing agent.

11. The method of claim 9 or 10 wherein said deodorizing agent is sodium bicarbonate.

* * * * *